US010174951B2

(12) United States Patent
Choi

(10) Patent No.: US 10,174,951 B2
(45) Date of Patent: Jan. 8, 2019

(54) COOKING APPLIANCE

(71) Applicant: LG ELECTRONICS INC., Seoul (KR)

(72) Inventor: Moonho Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 263 days.

(21) Appl. No.: 15/064,937

(22) Filed: Mar. 9, 2016

(65) Prior Publication Data

US 2016/0265786 A1 Sep. 15, 2016

(30) Foreign Application Priority Data

Mar. 11, 2015 (KR) ..... 10-2015-0033978

(51) Int. Cl.
*F24C 3/12* (2006.01)

(52) U.S. Cl.
CPC ..... *F24C 3/124* (2013.01); *F24C 3/122* (2013.01)

(58) Field of Classification Search
CPC ..... Y10T 16/506; G05G 1/00; G05G 1/10; G05G 1/12; G05G 23/02; G05G 2700/20; E05B 1/00; E05B 1/0007; E05B 1/003; F24C 3/122; F24C 3/126; F24C 3/124; A47J 37/0647; A21B 1/33; F23N 1/007
USPC ..... 267/36.1; 70/207; 126/39 E, 37 R, 50
See application file for complete search history.

(56) References Cited

U.S. PATENT DOCUMENTS 2,005,792 A * 6/1935 Leins ..... F24C 3/124 126/39 R
2,420,979 A * 5/1947 Reeves ..... F24C 3/124 16/441
2,635,640 A * 4/1953 Nellis ..... H05B 1/0208 200/83 P
7,537,612 B2 * 5/2009 Kunzler ..... A61F 2/4425 623/17.13
2012/0073884 A1 * 3/2012 Guthrie ..... B60G 11/00 177/225
2013/0098742 A1 * 4/2013 Bowen ..... F24C 3/124 200/336
2014/0047943 A1 * 2/2014 Camli ..... G05G 1/08 74/553
2014/0047944 A1 * 2/2014 Camli ..... F24C 3/126 74/553

FOREIGN PATENT DOCUMENTS

| | | |
|---|---|---|
| JP | S62-041526 | 2/1987 |
| JP | H09-106600 | 4/1997 |
| KR | 20-1998-0031460 | 8/1998 |
| KR | 10-1140121 | 4/2012 |

* cited by examiner

*Primary Examiner* — Avinash Savani
*Assistant Examiner* — Rabeeul Zuberi
(74) *Attorney, Agent, or Firm* — Fish & Richardson P.C.

(57) ABSTRACT

A cooking appliance is disclosed. The cooking appliance includes a cabinet defining the external appearance of the cooking appliance, a cooking unit provided in the cabinet for performing cooking using a heat source, a panel having a through hole, a heat source control unit provided at the rear of the panel, the heat source control unit having a shaft extending to the front of the panel through the through hole, a knob provided at the front of the panel in a state of being connected to the shaft for rotating the shaft according to user's manipulation, a knob ring provided between the knob and the panel for receiving at least a portion of the knob, and a knob ring holder coupled to the knob ring at the rear of the panel for allowing the knob ring to move on a front surface of the panel in a radial direction of the knob ring.

20 Claims, 6 Drawing Sheets

COOKING APPLIANCE

This application claims the benefit of Korean Patent Application No. 10-2015-0033978, filed on Mar. 11, 2015, which is hereby incorporated by reference as if fully set forth herein.

BACKGROUND OF THE INVENTION

Field of the Invention

The present invention relates to a cooking appliance, particularly to a cooking appliance configured such that a heat source control unit is manipulated using a rotary knob, and more particularly to a cooking appliance configured such that the restraint of a rotary knob or a shaft of a heat source control unit connected with the rotary knob is prevented.

Discussion of the Related Art

Cooking appliances are products that cook food using electricity or other kinds of energy at home.

Among cooking appliances, there are a gas stove, a gas oven, and a gas oven/stove, which use gas. In the gas stove, the gas oven, and the gas oven/stove, food is cooked using the combustion of gas. In addition, there are a microwave oven and a microwave oven/stove, which use electricity. Of course, one cooking appliance may use multiple kinds of energy, such as both electricity and gas.

FIG. 1 is a side view showing a general oven/stove, which is an example of such a cooking appliance. Of course, the cooking appliance shown in FIG. 1 may be a cooking appliance according to an embodiment of the present invention. That is, FIG. 1 is merely an illustration for describing the construction of a general cooking appliance.

As shown in FIG. 1, a cooking appliance 10 or an oven/stove includes a cabinet 20 defining the external appearance of the cooking appliance. In the cabinet 20 may be defined a chamber 25 for receiving food to be cooked. Of course, the chamber 25 may be omitted from the cooking appliance 10.

A cooktop 26, on which cooking containers are placed, may be provided at the upper side of the cabinet 20. That is, cooking containers, such as pots, may be located on the cooktop 26 such that cooking is performed using heat generated from underneath the cooktop.

The chamber 25 or the cooktop 26 may be a cooking unit, in which cooking is performed using heat generated from gas or electricity. Based on the kind of cooking appliance, various cooking units may be provided. For example, the cooking unit may be configured such that cooking is performed through the direct use of heat generated from gas or through the radiation or conduction of heat generated from gas.

The cabinet 20 may be provided at the front thereof with a door 50 for opening and closing the chamber 25. A handle 60 may be provided at the door 50. A user may open and close the door 50 while holding the handle 60.

The cooking appliance may include a panel 30, which may be integrally formed with the cabinet 20 or may be coupled to the cabinet 20. The panel 30 may be provided with a manipulation unit for allowing a user to control the cooking appliance.

The manipulation unit may be configured to supply heat generated from gas, to stop the supply of heat generated from gas, and to adjust the intensity of heat generated from gas. Of course, the manipulation unit may also be configured to drive an electric heater or to adjust the amount of heat that is generated by the electric heater. The manipulation unit may include a timer. In addition, the manipulation unit may further include a display part for informing the user of cooking information or a current state of the cooking appliance.

The panel 30 may be provided with a knob 40. The knob 40 may be configured to supply heat generated from gas or to drive the electric heater according to the user's manipulation. That is, the knob 40 is an example of the manipulation unit. The knob 40 may be manipulated to adjust the amount of heat that is supplied.

For example, the user may manipulate the knob 40 in order to supply heat generated from gas into the chamber or to supply heat generated from gas to a specific one selected from among a plurality of cooking elements. Consequently, a plurality of knobs 40 may generally be provided as the manipulation unit.

Each knob 40 may generally be connected to a shaft (see FIG. 3) of a heat source control unit (see FIG. 3) located at the rear of the panel 30. The knob 40 may generally be rotated in order to supply heat generated from gas or to drive the electric heater. The motion of the knob 40 may be transmitted to the heat source control unit through the shaft. As a result, heat generated from gas may be supplied to the chamber or a specific one of the cooking elements, or the electric heater may be driven.

As shown in FIG. 1, the panel 30 may be provided at the front of the cabinet 20. Alternatively, the panel 30 may be provided at the top of the cabinet. As shown in FIG. 1, the panel 30 may be provided in an inclined state. Alternatively, the panel 30 may be provided vertically. Consequently, the position and attitude of the knob 40 may be changed depending upon the position or shape of the panel 30.

In recent years, there have been provided cooking appliances in which the knob 40 is made of an aluminum material or a zinc material in consideration of safety and design. That is, the knob 40 has been manufactured using a metal material in order to improve the design of the knob 40 by imparting the gloss of metal. In addition, the knob 40 has been manufactured such that the knob 40 is too heavy for children to easily manipulate the knob 40.

In many cases, the knob 40 may be oriented vertically at the front of the cooking appliance. This means that the shaft is oriented horizontally, i.e. parallel to the ground. For this reason, the shaft may be deformed or deviated positionally. Such deformation or positional deviation (eccentricity) of the shaft may cause the restraint of the shaft. As a result, the rotation of the shaft may be restrained.

The restraint of the shaft may frequently occur when the knob 40 is heavy. In particular, when the shaft is oriented horizontally, the restraint of the shaft may occur more frequently.

Meanwhile, in a case in which a knob ring is used as in an embodiment of the present invention, as will hereinafter be described, the knob 40 may be restrained by the knob ring. This is because the center of the knob may deviate from the center of the knob ring in a state in which the knob ring is not moved. Such restraint may occur due to deformation or eccentricity of the shaft. Therefore, there is a high necessity for a cooking appliance configured such that the restraint of the knob or the shaft is prevented.

SUMMARY OF THE INVENTION

Accordingly, the present invention is directed to a cooking appliance that substantially obviates one or more problems due to limitations and disadvantages of the related art.

An object of the present invention is to provide a cooking appliance configured such that the restraint between a knob and a shaft of a heat source control unit is prevented.

Another object of the present invention is to provide a cooking appliance configured such that the deformation or eccentricity of a shaft of a heat source control unit is prevented.

Another object of the present invention is to provide a cooking appliance configured such that the restraint of a knob is prevented even when a shaft of a heat source control unit is eccentrically mounted during an assembly process.

Another object of the present invention is to provide a cooking appliance configured such that the restraint of a knob is prevented even when the knob is relatively heavy.

Another object of the present invention is to provide a cooking appliance that can be easily and simply assembled.

Another object of the present invention is to provide a cooking appliance configured such that the eccentricity of a knob and a shaft of a heat source control unit is compensated for.

A further object of the present invention is to provide a cooking appliance exhibiting improved reliability and durability.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a cooking appliance includes a cabinet defining the external appearance of the cooking appliance, a cooking unit provided in the cabinet for performing cooking using a heat source, a panel having a through hole, a heat source control unit provided at the rear of the panel, the heat source control unit having a shaft extending to the front of the panel through the through hole, a knob provided at the front of the panel in a state of being connected to the shaft for rotating the shaft according to a user's manipulation, a knob ring provided between the knob and the panel for receiving at least a portion of the knob, and a knob ring holder coupled to the knob ring at the rear of the panel for allowing the knob ring to move on a front surface of the panel in a radial direction of the knob ring.

In another aspect of the present invention, a cooking appliance includes a cabinet defining the external appearance of the cooking appliance, a cooking unit provided in the cabinet for performing cooking using a heat source, a panel having a through hole, a heat source control unit provided at the rear of the panel, the heat source control unit having a shaft extending to the front of the panel through the through hole, a knob provided at the front of the panel in a state of being connected to the shaft for rotating the shaft according to a user's manipulation, a knob ring provided between the knob and the panel for receiving at least a portion of the knob, and a knob ring holder connected to the knob ring for allowing the movement of the knob ring such that the center of the knob ring is aligned with the center of the knob.

The knob ring holder may be connected to the knob ring in order to prevent the knob ring from being separated from the panel. That is, the knob ring and the knob ring holder may be coupled to each other such that the knob ring and the knob ring holder are not separated from the panel. That is, as long as any one of the knob ring, the knob ring holder, and the panel is not damaged, the knob ring and the knob ring holder are not separated from the panel. The knob ring holder may allow the knob ring to move relative to the panel while preventing the knob ring from being separated from the panel.

The knob ring holder may be coupled to the knob ring at the rear of the panel for allowing the knob ring to move on the front surface of the panel in the radial direction of the knob ring. The knob ring holder may be located at the rear surface of the panel and configured to allow the knob ring to move in the radial direction at the front surface of the panel. In some cases, the knob ring holder may be located at the front surface of the panel.

The heat source may be gas or electricity. Correspondingly, the heat source control unit may be a gas valve or a regulator. The gas valve may supply gas or interrupt the supply of gas, and may change the pressure of gas that is supplied in order to change the amount of heat that is supplied. The regulator may supply electric power or interrupt the supply of electric power, and may increase or decrease current or voltage in order to change the amount of heat that is supplied. The shaft is provided in order to turn the heat source control unit ON or OFF or to control the amount of heat that is supplied. The larger the rotational angle of the shaft, the larger the amount of heat that is supplied. The knob may be provided in order to easily manipulate the shaft.

A user may manipulate the knob in order to control the heat source control unit using the shaft. For this reason, if the knob is restrained by the knob ring, it may be difficult for the user to manipulate the knob.

The knob ring holder may allow the movement of the knob ring such that the center of the knob ring is aligned with the center of the knob. That is, the knob ring holder may allow the knob ring to move relative to the panel in the radial direction. As a result, the centers of the knob and the knob ring may be aligned.

External force may be applied to the knob ring due to misalignment between the center of the knob and the center of the knob ring holder, and the knob ring and the knob ring holder may move simultaneously as a single body. Consequently, the knob ring and the knob ring holder may be coupled to each other to constitute a single body.

The knob ring holder may include a base, a coupling part protruding from the base in a forward direction so as to be coupled to the knob ring, a through part for allowing the shaft to extend therethrough, and a tight contact part provided at the base so as to be brought into tight contact with the rear surface of the panel. The tight contact part may include a leaf spring. Alternatively, the tight contact part may be a leaf spring itself.

The leaf spring may be integrally formed with the base. That is, the base and the leaf spring may be made of a plastic material, and the base and the leaf spring may be integrally formed. As a result, the knob ring holder may be a single structural element.

A plurality of leaf springs may be arranged in a circumferential direction. As a result, the knob ring holder may be securely supported at the panel without positional deviation.

Each of the leaf springs may protrude from the base in an arc shape, and may be configured such that the width of each of the leaf springs in the circumferential direction is greater than the width of each of the leaf springs in the radial direction.

The base may be provided with rectangular holes or incised parts, each of which has a relatively large width in the circumferential direction, and each of the leaf springs may be formed so as to interconnect opposite sides of a corresponding one of the holes or the incised parts in the circumferential direction.

Consequently, each of the leaf springs may be formed in a belt shape extending in the circumferential direction. The belt shape may be configured such that the width of belt shape in the circumferential direction is greater than the width of the belt shape in the radial direction. For this reason, the rotation of the knob ring holder may be more easily performed than the movement of the knob ring holder in the radial direction. The rotation of the knob ring holder may be negligible due to the shape of the knob ring holder. In the same manner, the rotation of the knob ring may be negligible due to the shape of the knob ring. That is, symmetry of the knob ring and the knob ring holder in the circumferential direction may be maintained due to the circular shape of the knob ring and the knob ring holder even when the knob ring and the knob ring holder are rotated.

The movement of the knob ring holder in the radial direction may be more difficult than the rotation of the knob ring holder due to the shape of the leaf springs. As a result, the knob ring holder may be prevented from easily moving in the radial direction when a small force is applied thereto.

The coupling part may be coupled to the knob ring through the through hole, and the outer diameter defined by the coupling part may be less than the inner diameter of the through hole.

A plurality of coupling parts may be provided, and a range of the movement of the knob ring may be restricted by the distance between each of the coupling parts and the through hole in the radial direction. That is, the movement of the knob ring holder in the radial direction may be performed until the coupling parts are caught in through hole. As a result, the distance that the knob ring holder moves in the radial direction may be restricted.

One of the knob ring and the knob ring holder may have a coupling part configured to be inserted through the through hole, the other of the knob ring and the knob ring holder may have a coupling hole for allowing the coupling part to be coupled therein, and the outer diameter defined by the coupling part may be smaller than the inner diameter of the through hole such that the coupling part is allowed to move in the through hole in the radial direction. This may mean that a range of the movement of the coupling part is restricted by the inner diameter of the through hole.

The through part, configured to allow the shaft to extend therethrough, may be located at the center of the base, and a plurality of coupling parts may be arranged in the circumferential direction of the through part. Each of the coupling parts may be a hook having a curved outer surface corresponding to the through hole. Since the curved outer surfaces of the coupling parts are brought into contact with the through hole, the coupling parts or the through hole may be prevented from being damaged.

The knob ring may include a ring-shaped frame having an opening formed at the front part thereof such that at least a portion of the knob is received in the frame and a rear wall provided at the rear part of the frame such that the rear wall is brought into tight contact with the front surface of the panel.

The rear wall may include a through part formed at the center of the rear wall for allowing the shaft to extend therethrough and a coupling hole for allowing the coupling part to be coupled thereto.

The panel may be provided with a guide hole, formed outside the through hole, and the knob ring may be provided with an insertion protrusion, configured to be inserted through the guide hole. The insertion protrusion may be inserted through the guide hole such that the knob ring and the knob ring holder are temporarily coupled to each other.

The guide hole and the insertion protrusion may be provided in ones. That is, only one guide hole may be provided outside the through hole in the radial direction. The reason for this is that if two or more guide holes and two or more insertion protrusions are provided, the movement of the knob ring and the knob ring holder in the radial direction may be restrained due to coupling between the guide holes and the insertion protrusions.

The guide hole may be located at the left or right of the through hole such that the center of the guide hole is aligned with the center of the through hole, and the guide hole may be formed in a long hole shape having a relatively large width in a leftward and rightward direction. More specifically, the center of the guide hole and the center of the through hole may form a horizontal line.

The insertion protrusion may move in the long hole in the leftward and rightward direction due to the characteristics of the long hole. This may mean that the knob ring holder may move relative to the panel in the leftward and rightward direction.

In a further aspect of the present invention, a cooking appliance includes a cabinet defining the external appearance of the cooking appliance, a cooking unit provided in the cabinet for performing cooking using a heat source, a panel having a through hole, a heat source control unit provided at the rear of the panel, the heat source control unit having a shaft extending to the front of the panel through the through hole, a knob provided at the front of the panel in a state of being connected to the shaft for rotating the shaft according to user's manipulation, a knob ring provided at the front surface of the panel for allowing the knob to rotate while surrounding the knob at the outside of the knob in a radial direction, and a knob ring holder coupled to the knob ring at the rear of the panel, wherein the knob ring holder includes a tight contact part configured to be elastically deformed in a state of being brought into tight contact with the rear surface of the panel for allowing the knob ring holder and the knob ring to move in the radial direction.

The cooking unit may be a cooktop or a chamber.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
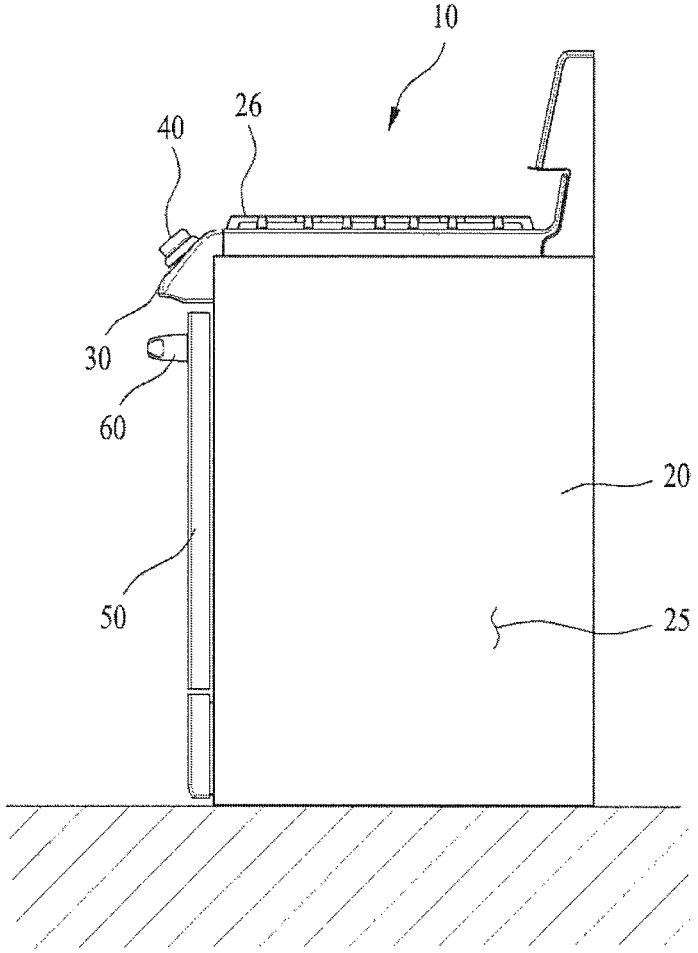
FIG. 1 is a side view showing a general cooking appliance or a gas oven/stove that is applicable to an embodiment of the present invention.
Figure 2:
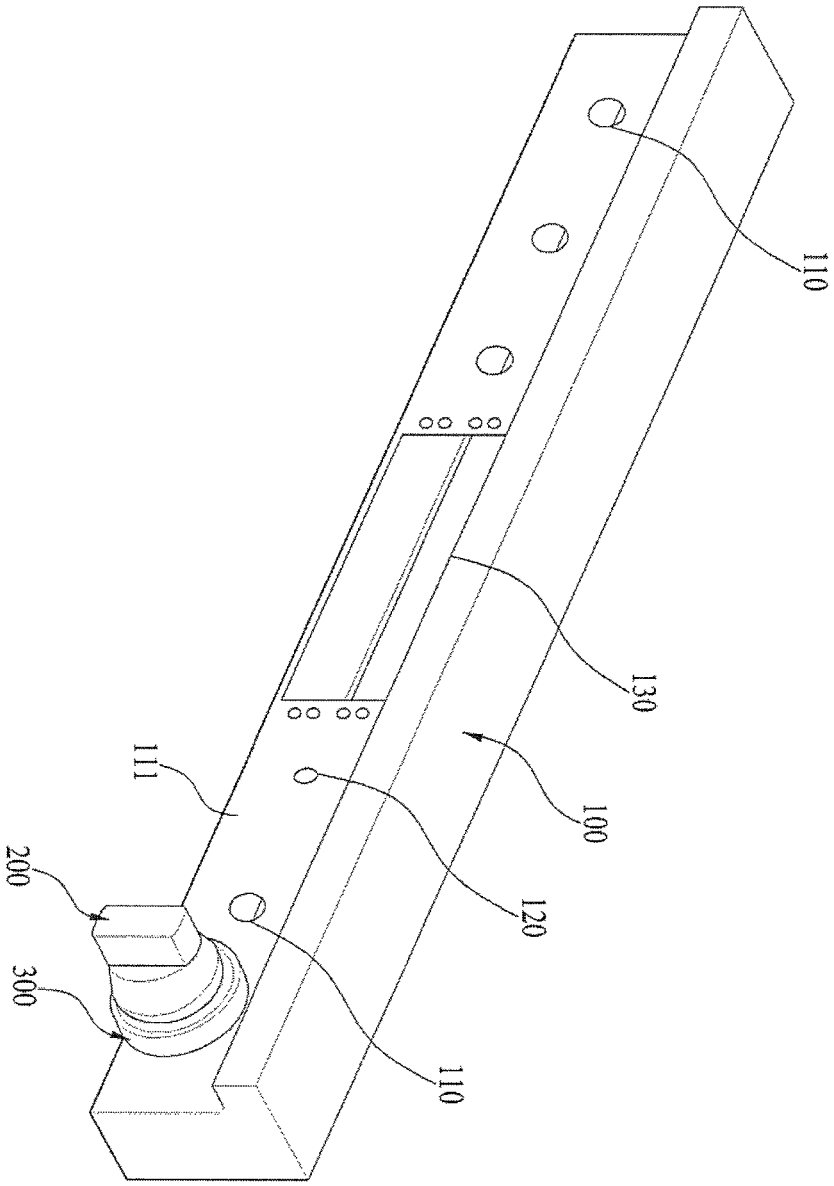
FIG. 2 is a perspective view showing a panel of a conventional cooking appliance or a cooking appliance that is applicable to an embodiment of the present invention.

FIG. 2 is a perspective view showing a panel 100 of a conventional cooking appliance or a panel of a cooking appliance according to an embodiment of the present invention. For the convenience of description, other constructions of the cooking appliance, such as a cabinet and a cooking unit, are omitted from FIG. 2. The cooking appliance according to the embodiment of the present invention may be identical or similar to the conventional cooking appliance in terms of the external appearance of the front part of the panel.

The panel 100 shown in FIG. 2 may be applied to a gas oven/stove. Similarly, the panel 100 may also be applied to a gas stove or a gas oven. Hereinafter, an embodiment of a gas oven/stove will be described as an example of the cooking appliance. Of course, the panel 100 may also be applied to an electric oven/stove or an electric stove.

The panel 100 may be provided therein with a plurality of through holes 110. A knob 200 may correspond to each of the through holes 110. Consequently, the panel 100 may be provided with a plurality of knobs 200. The panel 100 shown in FIG. 2 may be provided with four cooktop knobs and one oven knob 200. In addition, the panel 100 may be provided with a timer through hole 120. An identical or similar knob may be provided at the front of the timer through hole 120. The timer through hole 120 may have a smaller diameter than the other through holes 110.

The panel 100 may be provided with a window 130, in which a display unit is mounted.

A knob ring 300 may be provided between the knob 200 and the panel 100. The knob ring 300 may keep the knob 200 in tight contact with the panel 100 in order to prevent moisture or foreign matter from being introduced into the panel 100 through the through hole 110. In addition, the knob 200 may be received in a portion of the front of the knob ring 300. Consequently, the knob 200 may be rotatable relative to the knob ring 300.

The knob ring 300 may be located around the knob 200 to protect the knob 200 and to prevent moisture or foreign matter from being introduced into the panel 100 through the knob 200.

Specifically, the knob ring 300 may be provided at a front surface 111 of the panel 100. In addition, the knob 200 may be provided at the front of the panel 100 in a state in which at least a portion of the knob 200 is received in the knob ring 300. As a result, it is possible for a user to easily manipulate the knob 200 from the front of the cooking appliance.

Hereinafter, the panel according to the embodiment of the present invention will be described in more detail with reference to FIGS. 3 to 5.

Figure 3:
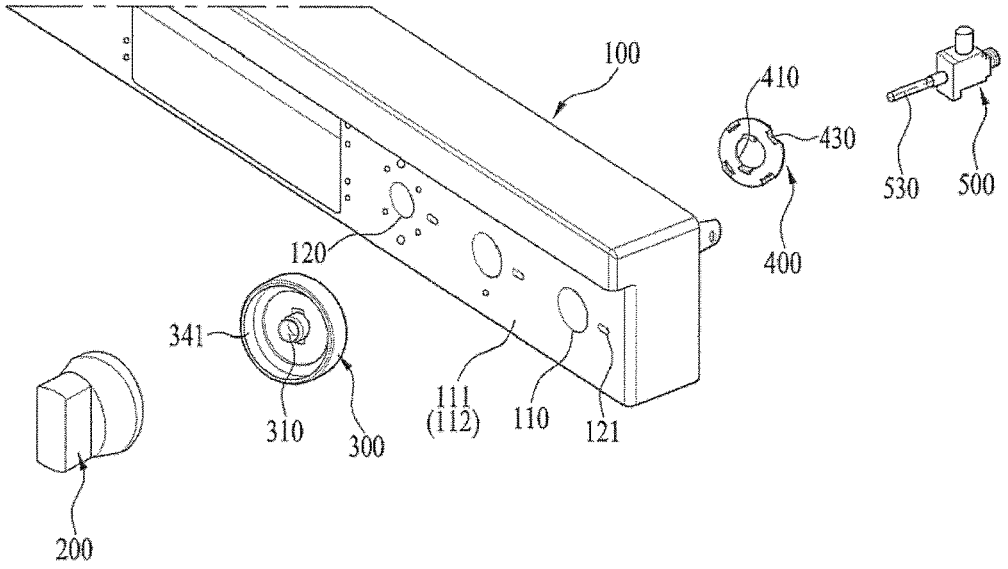
FIG. 3 is an exploded perspective view showing a panel according to an embodiment of the present invention in a state in which a knob is separated from the panel.

FIG. 3 is an exploded perspective of the panel 100 shown in FIG. 2 in a state in which the knob 200 and the knob ring 300 are separated from the panel 100. Unlike the conventional panel, in this embodiment, it is possible to effectively prevent the restraint of a shaft by the provision of a knob ring holder 400. In addition, it is possible to effectively prevent the knob 200 from being restrained by the knob ring 300.

Specifically, the knob ring 300 may be located at the front surface 111 of the panel 100, and the knob ring holder 400 may be located at a rear surface 112 of the panel 100. That is, the knob ring 300 may be located at the front of the through hole 110 formed at the panel 100, and the knob ring holder 400 may be located at the rear of the through hole 110. The knob ring 300 and the knob ring holder 400 may be coupled to each other in a state in which the panel 100 is interposed between the knob ring 300 and the knob ring holder 400. Consequently, the knob ring holder 400 may be an element for coupling the knob ring 300 to the panel 100.

A heat source control unit 500 is located at the rear of the panel 100. The heat source control unit 500 is provided with a shaft 530. The shaft 530 extends from the heat source control unit 500 so as to protrude to the front of the through hole 110. The shaft 530 is coupled to the knob 200 at the front of the panel 100. When the knob 200 is rotated, therefore, the shaft 530 may also rotate.

The shaft 530 may be rotated to manipulate the heat source control unit 500. The heat source control unit 500 may be a gas valve or a regulator. When the shaft 530 is rotated, the gas valve may be opened, or an electric heater may be driven. As a rotational angle of the shaft 530 is increased, the amount of heat that is generated may increase. Of course, the gas valve or the regulator is a structural element that is generally used in cooking appliances.

A portion of the knob 200 is received in the knob ring 300. As shown in FIG. 2, a portion of the rear part of the knob 200 may be rotated in a state of being received in the knob ring 300.

The knob ring 300 may be provided with a through part 310. The knob ring holder 400 may also be provided with a through part 410. The through parts 310 and 410 may be formed at the centers of the knob ring 300 and the knob ring holder 400, respectively. The through parts 310 and 410 may be configured such that the shaft 530 extends through the through parts 310 and 410. Consequently, at the rear of the panel 100, the shaft 530 may sequentially extend through the through part 410 of the knob ring holder 400, the through hole 110 of the panel 100, and the through part 310 of the knob ring 300, and may then be coupled to the knob 200. Basically, the shaft 530 may constitute the centers of the knob 200, the knob ring 300, and the knob ring holder 400. As will hereinafter be described, however, the shaft 530 may be deformed or deviated positionally due to external force that is applied through the knob 200. The knob 200 may deviate from the center of the through hole 110 due to such positional deviation (e.g. eccentricity).

Hereinafter, a relationship between the knob ring 300 and the knob ring holder 400 will be described in detail with reference to FIGS. 4 and 5.

Figure 4:
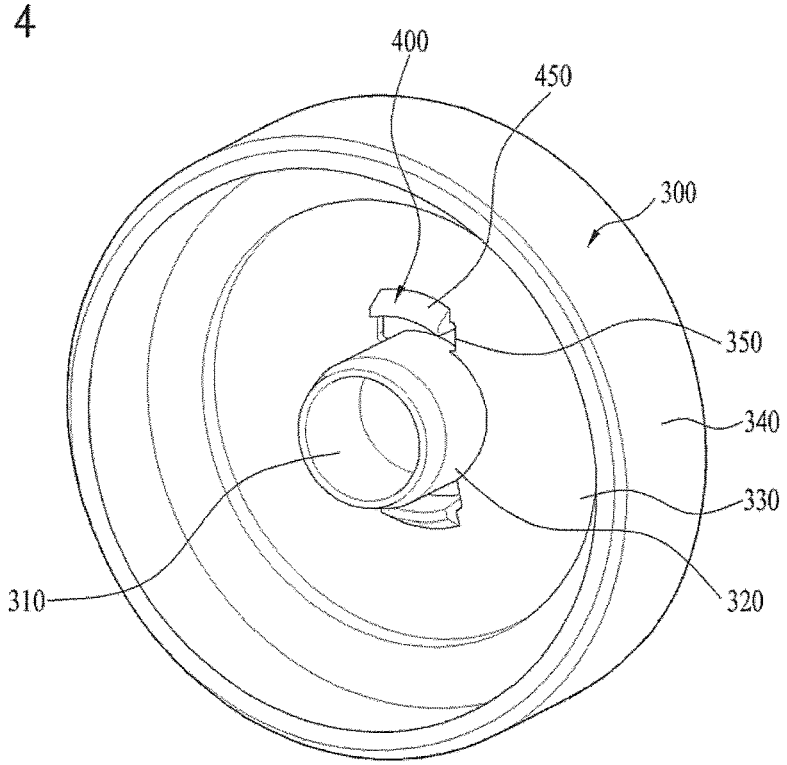
FIG. 4 is a front perspective view showing a state in which a knob ring and a knob ring holder according to an embodiment of the present invention are coupled to each other.
Figure 5:
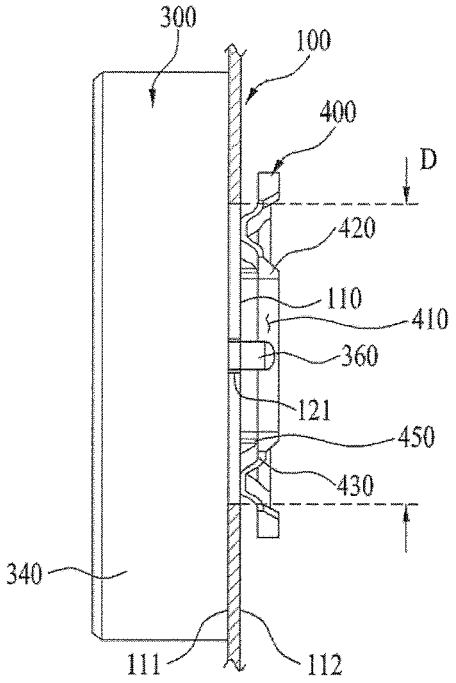
FIG. 5 is a side sectional view showing a state in which the knob ring and the knob ring holder according to the embodiment of the present invention are coupled to each other.

FIG. 4 is a front perspective view showing a state in which the knob ring 300 and the knob ring holder 400 are coupled to each other, and FIG. 5 is a side sectional view showing a state in which the knob ring 300 and the knob ring holder 400 are coupled to each other.

As previously described, the knob ring 300 and the knob ring holder 400 are coupled to each other. That is, the knob ring 300 and the knob ring holder 400 may be mechanically coupled to each other. The knob ring holder 400 may be a structural element that is coupled to the knob ring 300 to fix the knob ring 300 to the panel 100. However, the knob ring 300 may not be completely fixed to the panel 100 by the knob ring holder 400.

In general, the knob ring 300 is fixed to the panel 100 using screws. As long as the screws or the knob ring 300 is not damaged, therefore, the knob ring 300 is securely fixed to the panel 100. The movement of the knob ring 300 is restrained, whereas the center of the knob 200 may be moved by eccentricity of the shaft 530 or external force applied to the shaft 530. In other words, the knob 200 moves relative to the knob ring 300 in a radial direction, resulting in the eccentricity of the shaft 530.

That is, the center of the knob ring 300 and the center of the knob 200 may not be aligned. As a result, a portion of the knob 200 may be caught in the knob ring 300. In this state, it may be difficult for the user to manipulate the knob 200.

However, the knob ring holder 400 according to the embodiment of the present invention may be a structural element for fixing the knob ring 300 to the panel 100 such that the knob ring 300 is allowed to move in a radial direction. Of course, it is necessary to prevent the knob ring 300 from moving easily when a small external force is applied in the radial direction. A concrete example of the knob ring holder 400 that accomplishes this will hereinafter be described.

First, the knob ring 300 and the knob ring holder 400 may be coupled to each other through various mechanical coupling structures. Screw coupling or hook coupling may also be used. In this embodiment, the knob ring 300 and the knob ring holder 400 are coupled to each other by hook coupling. The knob ring 300 and the knob ring holder 400 may be coupled to each other through various mechanical coupling structures as long as the knob ring 300 and the knob ring holder 400 can move simultaneously as a single body.

As shown in FIG. 4, the knob ring 300 is provided with a coupling hole 350. Correspondingly, the knob ring holder 400 is provided with a coupling part 450. The knob ring 300 and the knob ring holder 400 are coupled to each other by inserting the coupling part 450 through the coupling hole 350. Of course, an example of the coupling part 450 may be a hook.

When the coupling part 450 is inserted through the coupling hole 350, the knob ring 300 and the knob ring holder 400 substantially constitute a single assembly. When one of the knob ring 300 and the knob ring holder 400 moves relative to the panel 100 in a radial direction, the other of the knob ring 300 and the knob ring holder 400 also moves relative to the panel 100 in the radial direction.

As shown in FIG. 5, the knob ring 300 and the knob ring holder 400 are coupled to each other in a state in which the panel 100 is interposed between the knob ring 300 and the knob ring holder 400. That is, the knob ring 300 is located at the front surface 111 of the panel 100, and the knob ring holder 400 is located at the rear surface 112 of the panel 100. Consequently, the coupling part 450 of the knob ring holder 400 may be coupled to the knob ring 300 through the panel 100. Of course, the positions at which the coupling part 450 and the coupling hole 350 are formed may be reversed. That is, the coupling part may be formed at the knob ring 300, and the coupling hole may be formed at the knob ring holder 400, such that the coupling part of the knob ring 300 is inserted through the coupling hole of the knob ring holder 400 through the panel 100.

When the knob ring 300 and the knob ring holder 400 are coupled to each other, the knob ring 300 and the knob ring holder 400 may be brought into tight contact with the panel 100. That is, the knob ring 300 may be brought into tight contact with the front surface 111 of the panel 100, and the knob ring holder 400 may be brought into tight contact with the rear surface 112 of the panel 100.

The coupling part 450 of the knob ring holder 400 may be inserted through the through hole 110 of the panel 100. That is, the coupling part 450 may extend from the rear surface 112 of the panel 100 to the front surface 111 of the panel 100 via the through hole 110 of the panel 100. For secure coupling between the knob ring 300 and the knob ring holder 400, the knob ring 300 may be provided with a plurality of coupling holes 350, and the knob ring holder 400 may be provided with a plurality of coupling parts 450. The coupling holes 350 and the plurality of coupling parts 450 may be arranged symmetrically in a circumferential direction. In one example, two or four pairs of coupling holes and coupling parts may be provided.

Meanwhile, all of the coupling parts 450 may be inserted through the through hole 110 of the panel 100. Consequently, an outer diameter d (see FIG. 6) of a circle defined by the coupling parts 450 may be smaller than an inner diameter D of the through hole 110 of the panel 100.

The difference between the inner diameter D and the outer diameter d is set such that the coupling parts 450 are inserted through the through hole 110 of the panel 100 in a state in which the movement of the coupling parts 450 in the radial direction is allowed. That is, the knob ring 300 and the knob ring holder 400, which includes the coupling parts 450, may move simultaneously due to the difference between the inner diameter D and the outer diameter d.

For example, in a state in which the center of the knob ring holder 400, the center of the knob ring 300, and the center of the through hole 110 of the panel 100 are aligned, the difference between the inner diameter D and the outer diameter d may be 10 mm. Consequently, the knob ring 300 and the knob ring holder 400 may move from the center of the through hole 110 of the panel 100 by up to 5 mm in the radial direction. That is, the knob ring 300 and the knob ring holder 400 may move relative to the panel 100 in the radial direction due to the difference between the inner diameter D and the outer diameter d. In other words, the knob ring 300 and the knob ring holder 400 may move upward, downward, leftward, and rightward in the radial direction. Considering a direction of gravity and a direction of external force depending upon how the knob 200 is used, the knob ring 300 and the knob ring holder 400 may move in the direction of gravity, i.e. in the radial direction, in most cases.

In an initial state, i.e. a state in which the shaft 530 or the knob 200 is not eccentric, however, the center of the knob ring 300 must be aligned with the center of the through hole 110 of the panel 100. That is, when the knob ring 300 and the knob ring holder 400 are assembled to the panel 100, the centers of the knob ring 300, the knob ring holder 400, and the through hole 110 of the panel 100 may be aligned.

After the center of the knob ring 300 is approximately aligned with the center of the through hole 110 of the panel 100, therefore, the knob ring 300 and the knob ring holder 400 may be coupled to each other.

To this end, the knob ring 300 may be provided with an insertion protrusion 360, as shown in FIG. 5. A guide hole 121, through which the insertion protrusion 360 is inserted, may be formed at the panel 100, as shown in FIG. 3. The guide hole 121 may be formed outside the through hole 110 of the panel 100 in the radial direction.

As shown in FIG. 3, the center of the guide hole 121 may be aligned with the center of the through hole 110 of the panel 100. Only one insertion protrusion 360 may be formed at the knob ring 300. Correspondingly, only one guide hole 121 may be formed at the panel 100. That is, only one guide hole 121 may be provided for each through hole 110 of the panel 100.

When the insertion protrusion 360 is inserted through the guide hole 121, the center of the knob ring 300 may be approximately aligned with the center of the through hole 110 of the panel 100. This is because one side of the knob ring 300 is temporarily fixed as a result of the insertion protrusion 360 being inserted through the guide hole 121, and, at this time, a user may move the other side of the knob ring 300 such that one side of and the other side of the knob ring 300 are level with each other.

In other words, when the insertion protrusion 360 is inserted through the guide hole 121, the knob ring 300 may be rotated about the guide hole 121. The user may perceive the approximate position of the guide hole 121 even though the user cannot see the guide hole 121. This is because the user may perceive the position of the center of rotation of the knob ring 300 by sensitively rotating the knob ring 300.

The rotating operation may be repeated several times such that the position opposite the insertion protrusion 360 (i.e. the position symmetric with the insertion protrusion 360 on the basis of the center of the knob ring 300) may be level with the position of the insertion protrusion 360. In this way, the center of the knob ring 300 may be approximately aligned with the center of the through hole 110 of the panel 100 even though the user cannot see the center of the through hole 110 of the panel 100 due to the knob ring 300. In this state, the knob ring holder 400 is coupled to the knob ring 300 at the rear of the panel 100. That is, the knob ring holder 400 is coupled to the knob ring 300 at the rear of the panel 100, and the movement of the knob ring 300 in the radial direction on the front surface of the panel 100 is allowed. More specifically, the knob ring 300 and the knob ring holder 400, which are coupled to each other, move relative to the panel in the radial direction of the knob ring 300. This means that the movement of the knob 200 relative to the panel 100 in the radial direction causes the movement of the knob ring 300 and the knob ring holder 400 relative to the panel 100 in the radial direction. In contrast, the movement of the knob ring 300 and the knob ring holder 400 relative to the panel 100 in the radial direction may cause the movement of the knob 200 relative to the panel 100 in the radial direction.

Consequently, the knob ring 300 and the knob ring holder 400 are eccentrically placed due to the eccentricity of the knob 200, whereby the centers of the knob 200, the knob ring 300, and the knob ring holder 400 are aligned with one another. In contrast, the knob 200 is eccentrically placed due to the eccentricity of the knob ring 300 and the knob ring holder 400, whereby the centers of the knob 200, the knob ring 300, and the knob ring holder 400 are aligned with one another. As a result, the restraint between the knob 200 and the knob ring 300 may be prevented.

As previously described, the center of the guide hole 121 may be aligned with the center of the through hole 110 of the panel 100. This is because a direction in which the knob 200 is restrained, a direction in which external force is applied to the knob 200, a direction in which the shaft 530 is deformed, and a direction of gravity may be considered, and the knob ring 300 and the knob ring holder 400 substantially move in the radial direction, particularly in the upward and downward directions.

That is, a range in which the movement of the knob ring 300 and the knob ring holder 400 is allowed may be set such that the knob ring 300 and the knob ring holder 400 can move a relatively large distance in the upward and downward direction, but can move only a relatively small distance in the leftward and rightward directions.

As previously described, the insertion protrusion 360 is inserted through the guide hole 121. For this reason, the movement of the knob ring 300 relative to the panel 100 in the leftward and rightward direction may be restrained. As shown in FIG. 3, therefore, the guide hole 121 may be formed to have a long hole shape configured such that the width in the leftward and rightward directions is greater than the width in the upward and downward directions. Due to the width of the guide hole 121 in the leftward and rightward directions, the extent to which the knob ring 300 and the knob ring holder 400 can move in the leftward and rightward directions may be restrained. Of course, the extent to which the knob ring 300 and the knob ring holder 400 can move in the leftward and rightward directions may be less than the extent to which the knob ring 300 and the knob ring holder 400 can move in the upward and downward directions. This is because the insertion protrusion 360 constitutes the center of rotation of the knob ring 300.

Consequently, the extent to which the knob ring 300 and the knob ring holder 400 can move in the upward and downward directions (D/2−d/2) may be greater than the extent to which the knob ring 300 and the knob ring holder 400 can move in the leftward and rightward directions, which is restrained by the shape of the guide hole 121. As a result, the knob ring 300 and the knob ring holder 400 are allowed to move radially relative to the panel 100 in upward, downward, leftward, and rightward directions. Of course, the width of the movement of the knob ring 300 and the knob ring holder 400 may be restricted depending upon the difference between the diameters D and d and the position and the shape of the guide hole 121. As a result, it is possible to prevent excessive movement of the knob ring 300 and the knob ring holder 400.

As shown in FIG. 4, the knob ring 300 may include a ring-shaped frame 340. An opening 341 may be formed at the front part of the ring-shaped frame 340 such that a portion of the knob 200 is received in the frame 340. The knob 200 may be formed in a circular shape, which corresponds to the shape of the frame 340. The knob 200 may be rotated in the frame 340.

The knob ring 300 may include a rear wall 330 provided at the rear part of the frame 340 such that the rear wall 330 is brought into tight contact with the front surface 111 of the panel 100. At least a portion of the rear wall 330 may be brought into tight contact with the front surface 111 of the panel 100.

The through part 310 may be formed through the center of the rear wall 330. The shaft 530 may extend through the through part 310. A hub 320 may be formed around the through part 310. The hub 320 may be formed at the center of the rear wall 330, and the through part 310 may be formed through the center of the hub 320. The hub 320 may protrude in a forward direction by a predetermined length. Consequently, the hub 320 may surround a predetermined length of the shaft 530, which extends through the through part 310. As a result, it is possible to more stably support the shaft 530.

The coupling holes 350 may be formed at the rear wall 330. The coupling holes 350 may be formed outside the through part 310 or the hub 320 in the radial direction. Consequently, the radius of a circle defined by the coupling holes 350 may be greater than that of the through part 310 or the hub 320. As a result, the knob ring 300 may be more securely coupled to the panel 100 or the knob ring holder 400.

Hereinafter, an embodiment of the knob ring holder 400 will be described in detail with reference to FIGS. 6 and 7.

The knob ring holder 400 is configured to allow the movement of the knob ring 300 in the radial direction. In addition, the knob ring holder 400 is coupled to the knob ring 300 at the rear of the panel 100.

The knob ring holder 400 allows the movement of the knob ring 300 such that the center of the knob ring 300 is aligned with the center of the knob 200. That is, the knob ring holder 400 allows the movement of the knob ring 300 in the radial direction. When the center of the knob 200 moves in the radial direction, the knob 200 is brought into tighter contact with the knob ring 300. As a result, the knob 200 is restrained. In addition, the knob 200 pushes the knob ring 300 in the same radial direction. That is, external force is applied to the knob ring 300 due to misalignment between the center of the knob 200 and the center of the knob ring 300 or the knob ring holder 400. As a result, the knob ring 300 and the knob ring holder 400 move simultaneously. That is, the knob ring holder 400 allows the knob ring 300 to move in response to the external force. In other words, when the knob 200 moves in a specific direction, the knob ring 300 also moves in the same direction, whereby the centers of the knob 200 and the knob ring 300 are aligned with each other. As a result, tight contact between the knob 200 and the knob ring 300 is prevented, and, at the same time, the restraint of the knob 200 and the knob ring 300 is prevented.

The knob ring holder 400 may include a base 420. The base 420 may be formed in a circular shape. The knob ring holder 400 may further include a tight contact part 430 protruding from the base 420 in a forward direction so as to be coupled to the knob ring 300. When the knob ring 300 and the knob ring holder 400 are coupled to each other, the tight contact part 430 is brought into tight contact with the rear surface 112 of the panel 100. In a state of being brought into tight contact with the rear surface 112 of the panel 100, the tight contact part 430 generates frictional force, by which the movement of the knob ring holder 400 in the radial direction is restrained. When external force that is greater than the frictional force is applied, the knob ring holder 400 may move in the radial direction. That is, the knob ring holder 400 may move only when external force having a predetermined magnitude is applied. This means that the knob ring 300 may move in the radial direction only when external force having a predetermined magnitude is applied to the knob ring 300.

The tight contact part 430 may include a leaf spring. Consequently, the tight contact part 430 may be elastically deformed in a direction in which the tight contact part 430 is pushed. The direction in which the tight contact part 430 is pushed may be a direction in which the knob ring 300 and the knob ring holder 400 are coupled to each other. Consequently, the knob ring 300 and the knob ring holder 400 may be coupled to each other as a result of the tight contact part 430 being deformed.

Hereinafter, the tight contact part 430 will be described as being a leaf spring. Consequently, the leaf spring may be denoted by the same reference numeral 430.

The leaf spring may be elastically deformed as a result of the coupling between the knob ring 300 and the knob ring holder 400. That is, the leaf spring may be pressed down against the rear surface 112 of the panel 100 with the result that the leaf spring may be elastically deformed. The greater the deformation of the leaf spring, as shown in FIG. 5, the larger the area of the leaf spring that contacts the rear surface 112 of the panel 100. The increase of contact area may cause the increase of frictional force. Consequently, the knob ring 300 and the knob ring holder 400 may be securely fixed to the panel 100. The knob ring 300 and the knob ring holder 400 may move in the radial direction only when external force having a predetermined magnitude (i.e. external force greater than frictional force) is applied.

The tight contact part 430 or the leaf spring may be integrally formed with the base 420. That is, the knob ring holder 400 may be made of a plastic material, and the base 420 and the leaf spring may be integrally formed.

A plurality of leaf springs 430 may be arranged in a circumferential direction. The leaf springs 430 may be arranged symmetrically in a circumferential direction of the knob ring holder 400.

Each of the leaf springs 430 may protrude from the base 420 in an arc shape, and may be configured such that the width of each of the leaf springs 430 in the circumferential direction is greater than the width of each of the leaf springs 430 in the radial direction. When force is applied to each of the leaf springs 430 such that the height of the arc of each of the leaf springs 430 is reduced, each of the leaf springs 430 may be elastically deformed due to the shape-based characteristics thereof.

Figure 6:
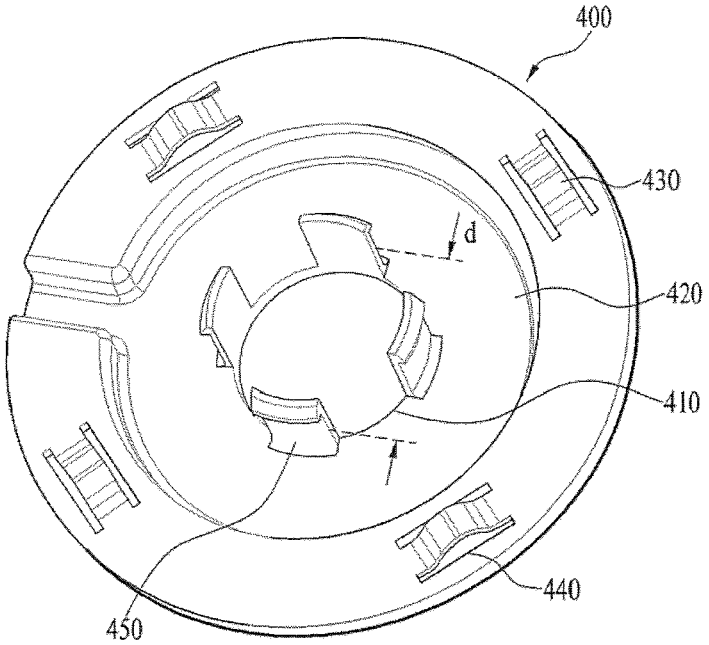
FIG. 6 is a front perspective view of the knob ring holder according to the embodiment of the present invention.
Figure 7:
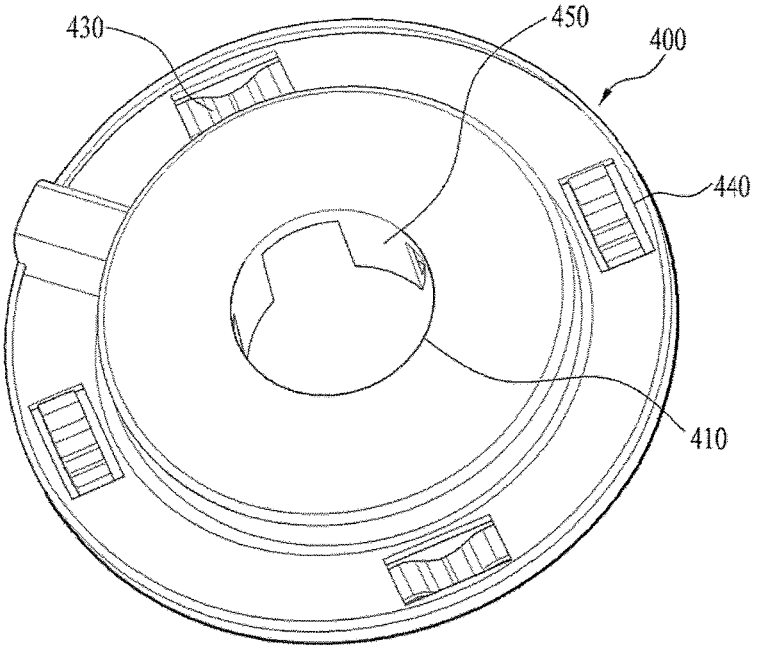
FIG. 7 is a rear perspective view of the knob ring holder shown in FIG. 6.

Specifically, as shown in FIG. 6, the base 410 may be provided with rectangular holes 440, each of which has a relatively large width in the circumferential direction. That is, each of the rectangular holes 440 may be configured such that the width of each of the rectangular holes 440 in the circumferential direction is greater than the width of each of the rectangular holes 440 in the radial direction. Each of the leaf springs 430 may be formed so as to bridge opposite sides of a corresponding one of the rectangular holes 440 in the circumferential direction. That is, each of the leaf springs 430 may be formed so as to protrude in a forward direction (i.e. toward the panel 100) in an arc shape.

The coupling parts 450 may be formed at the central part of the base 420. As previously described, each of the coupling parts 450 may be a hook. The through part 410 may be located inside the coupling parts 450 in the radial direction.

The coupling parts 450 may be formed outside the through part 410 in the radial direction such that the coupling parts 450 are arranged in the circumferential direction. A circle defined by the outer surfaces of the coupling parts 450 may have a specific outer diameter d. As previously described, the outer diameter d may be less than the inner diameter D of the through hole 110 of the panel 100. In addition, all of the outer surfaces of the coupling parts 450 may be curved. That is, the outer diameter d is defined by the curved surfaces of the coupling parts 450.

Even when the outer surfaces of the coupling parts 450 come into contact with the through part 410, therefore, impact and friction may be dispersed due to the characteristics of the curved surfaces of the coupling parts 450. As a result, it is possible to prevent the through part 410 or the through hole 110 from being damaged.

Figure 8:
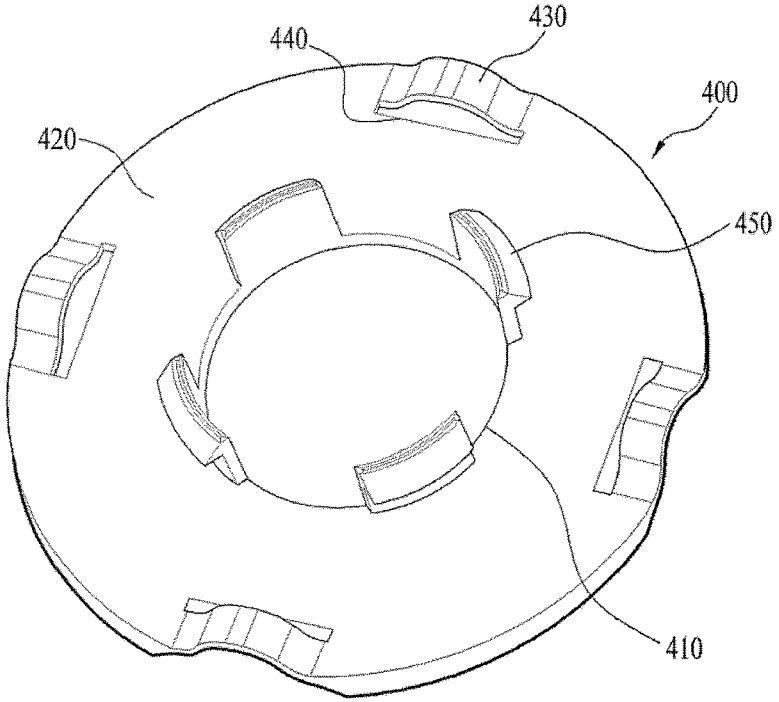
FIG. 8 is a front perspective view showing a knob ring holder according to another embodiment of the present invention.
Figure 9:
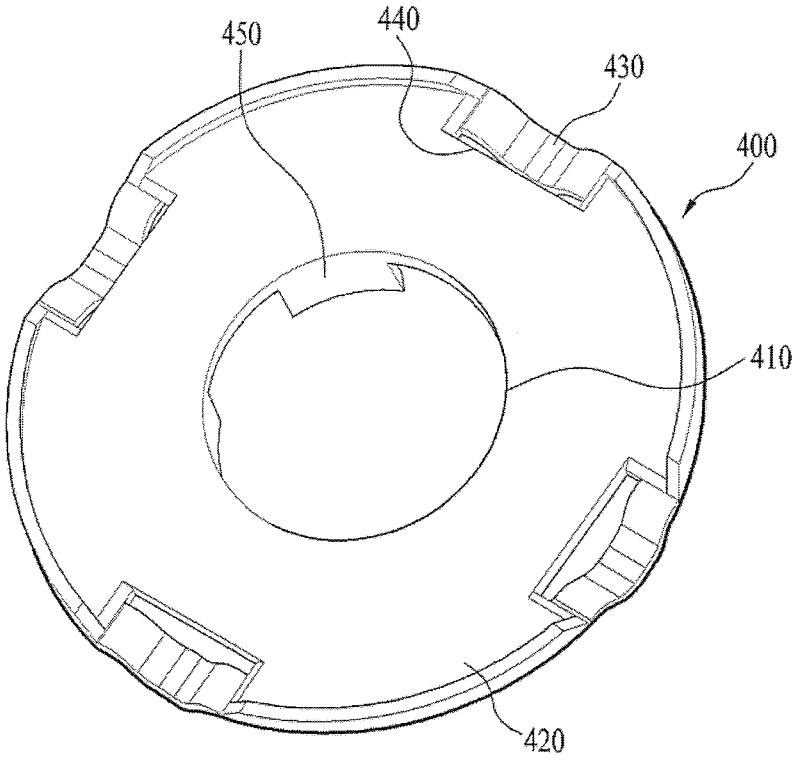
FIG. 9 is a rear perspective view of the knob ring holder shown in FIG. 8.

Hereinafter, another embodiment of the knob ring holder 400 will be described with reference to FIGS. 8 and 9.

This embodiment is similar to the previous embodiment except that the structure of the leaf springs 430 of this embodiment is different from that of the leaf springs 430 of the previous embodiment.

In this embodiment, the base 420 may be provided with incised parts, each of which has a relatively large width in the circumferential direction. For the convenience of description, the incised parts are denoted by the same reference numeral as the holes 440 of the previous embodiment.

Each of the leaf springs 430 may be formed so as to interconnect opposite sides of a corresponding one of the incised parts in the circumferential direction. Consequently, the leaf springs 430, which are elastically deformable, in the identical manner to those of the previous embodiment, may be integrally formed with the base 420.

In this embodiment, the base 420 may be formed to have a flat surface. On the other hand, the base 420 of the previous embodiment may be formed to have a stepped surface. The structure of the base 420 may differ depending upon the required rigidity of the base 420. In a case in which the base 420 has a stepped surface, it is possible to increase the rigidity of the base 420. In this case, however, the structure of the knob ring holder 400 may be complicated.

The movement of the knob ring 300 in the radial direction may be allowed by the knob ring holder 400 having the leaf springs 430 configured as described above. That is, the knob ring 300 may move in a direction in which eccentricity or restraint of the knob ring 300 is prevented. In addition, the distance that the knob ring 300 moves may be structurally restricted.

Restraint between the knob ring 300 and the knob 200 may occur due to a very small eccentricity, and such small eccentricity may be solved by the movement of the knob ring 300. Consequently, it is possible to prevent restraint between the knob ring 300 and the knob 200.

As is apparent from the above description, according to an embodiment of the present invention, it is possible to provide a cooking appliance configured such that the restraint between a knob and a shaft of a heat source control unit is prevented.

According to an embodiment of the present invention, it is possible to provide a cooking appliance configured such that the deformation or eccentricity of a shaft of a heat source control unit is prevented.

According to an embodiment of the present invention, it is possible to provide a cooking appliance configured such that the restraint of a knob is prevented even when a shaft of a heat source control unit is eccentrically mounted during an assembly process.

According to an embodiment of the present invention, it is possible to provide a cooking appliance configured such that the restraint of a knob is prevented even when the knob is relatively heavy.

According to an embodiment of the present invention, it is possible to provide a cooking appliance that can be easily and simply assembled.

According to an embodiment of the present invention, it is possible to provide a cooking appliance configured such that the eccentricity of a knob and a shaft of a heat source control unit is compensated for.

According to an embodiment of the present invention, it is possible to provide a cooking appliance exhibiting improved reliability and durability.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A cooking appliance comprising:

a cabinet defining an external appearance of the cooking appliance;

a cooking unit provided in the cabinet and configured to generate heat for cooking using a heat source;

a panel defining a through hole;

a heat source control unit provided at a rear side of the panel and configured to control the heat source, the heat source control unit having a shaft extending to a front side of the panel through the through hole;

a knob provided at the front side of the panel, the knob being connected to the shaft and configured to be manipulated by a user to rotate the shaft;

a knob ring provided between the knob and the panel, the knob ring being configured to receive at least a portion of the knob and located at a front surface of the panel; and a knob ring holder connected to the knob ring via the through hole and configured to allow the knob ring to move such that a center of the knob ring is aligned with a center of the knob, wherein the knob ring holder is located at a rear surface of the panel and configured to allow the knob ring to move in a radial direction with respect to the panel, and wherein the knob ring holder is coupled to the knob ring at the rear side of the panel to move together with the knob ring.

2. The cooking appliance according to claim 1, wherein the knob ring is configured to, based on the center of the knob and a center of the knob ring holder being misaligned, move to become aligned with the center of the knob in response to an external force from the knob.

3. The cooking appliance according to claim 1, wherein the knob ring holder comprises:

a base;

a coupling part protruding from the base in a forward direction and configured to be coupled to the knob ring;

a through part that is defined in the base and configured to allow the shaft to extend therethrough; and a contact part provided at the base and configured to be brought into contact with the rear surface of the panel.

4. The cooking appliance according to claim 3, wherein the contact part comprises a leaf spring.

5. The cooking appliance according to claim 4, wherein the leaf spring is integrally formed with the base.

6. The cooking appliance according to claim 4, wherein the leaf spring comprises a plurality of leaf springs arranged in a circumferential direction around the base.

7. The cooking appliance according to claim 6, wherein each of the leaf springs protrudes from the base in an arc shape, and a width of each of the leaf springs in the circumferential direction is greater than a width of each of the leaf springs in the radial direction.

8. The cooking appliance according to claim 7, wherein the base defines a plurality of rectangular holes or incised parts, each having a relatively larger width in the circumferential direction compared to the radial direction, and wherein each of the leaf springs interconnects opposite sides of a corresponding one of the plurality of rectangular holes or the incised parts in the circumferential direction.

9. The cooking appliance according to claim 3, wherein the coupling part is coupled to the knob ring through the through hole, and an outer diameter defined by the coupling part is less than an inner diameter of the through hole to allow the coupling part to move within the through hole in the radial direction.

10. The cooking appliance according to claim 3, wherein the coupling part comprises a plurality of coupling parts, and a range of the movement of the knob ring is defined by a distance between each of the coupling parts and the through hole in the radial direction.

11. The cooking appliance according to claim 3, wherein the through part is configured to allow the shaft to extend therethrough and is located at a center of the base, and the coupling part comprises a plurality of coupling parts arranged in the circumferential direction of the through part.

12. The cooking appliance according to claim 11, wherein each of the coupling parts comprises a hook having a curved outer surface corresponding to the through hole.

13. The cooking appliance according to claim 3, wherein the knob ring comprises:

a ring-shaped frame defining an opening formed at a front part of the frame such that the frame is configured to receive at least a portion of the knob; and a rear wall provided at a rear part of the frame such that the rear wall is configured to be brought into contact with the front surface of the panel.

14. The cooking appliance according to claim 13, wherein the rear wall defines a through part that is configured to allow the shaft to extend therethrough, and a coupling hole that is configured to be coupled to the coupling part.

15. The cooking appliance according to claim 1, wherein the panel defines a guide hole radially outside of the through hole, and the knob ring includes an insertion protrusion that is configured to be inserted through the guide hole.

16. The cooking appliance according to claim 15, wherein the guide hole and the insertion protrusion are provided in pairs for each through hole.

17. The cooking appliance according to claim 16, wherein the guide hole is located at a left or right side of the through hole such that a center of the guide hole is aligned with a center of the through hole, and the guide hole has a long hole shape having a relatively larger width in a leftward and rightward direction compared to an upward and downward direction.

18. A cooking appliance comprising:

a cabinet defining an external appearance of the cooking appliance;

a cooking unit provided in the cabinet and configured to generate heat for cooking using a heat source;

a panel defining a through hole;

a heat source control unit provided at a rear side of the panel and configured to control the heat source, the heat source control unit having a shaft extending to a front side of the panel through the through hole;

a knob provided at the front side of the panel, the knob being connected to the shaft and configured to be manipulated by a user to rotate the shaft;

a knob ring provided at a front surface of the panel and configured to surround an outside of the knob in a radial direction while allowing the knob to rotate; and a knob ring holder coupled to the knob ring at the rear of the panel, wherein:

one of the knob ring and the knob ring holder has a coupling part configured to be inserted through the through hole, the other of the knob ring and the knob ring holder defines a coupling hole for allowing the coupling part to be coupled thereto, and an outer diameter defined by the coupling part is less than an inner diameter of the through hole such that the coupling part is allowed to move in the through hole in the radial direction.

19. The cooking appliance according to claim 18, wherein the knob ring holder comprises a contact part that is configured to be elastically deformed based on being brought into contact with a rear surface of the panel and to allow the knob holder and the knob ring to move together in the radial direction with respect to the panel.

20. The cooking appliance according to claim 18, wherein the coupling part comprises a curved outer surface corresponding to the through hole.

* * * * *